United States Patent [19]

Zurwelle

[11] 4,015,350

[45] Apr. 5, 1977

[54] CARD FILE CONTROL

[75] Inventor: Rolf Zurwelle, Churchville, Md.

[73] Assignee: Business Efficiency Aids, Inc., Skokie, Ill.

[22] Filed: Nov. 17, 1975

[21] Appl. No.: 632,890

Related U.S. Application Data

[63] Continuation of Ser. No. 479,228, June 14, 1974, abandoned.

[52] U.S. Cl. ..... 40/105.5

[51] Int. Cl.[2] ..... G09D 1/00

[58] Field of Search ..... 40/105.5, 78, 102, 104.17, 40/104.19; 283/41

[56] References Cited

UNITED STATES PATENTS 2,954,032 9/1960 Dahl, Sr. ..... 40/105.5

FOREIGN PATENTS OR APPLICATIONS 77,274 2/1948 Norway ..... 283/41

*Primary Examiner*—Hugh R. Chamblee
*Assistant Examiner*—John H. Wolff
*Attorney, Agent, or Firm*—Olson, Trexler, Wolters, Bushnell & Fosse, Ltd.

[57] ABSTRACT

This invention provides control means for use in card files and the like for fanning the cards apart for improved readability. Resilient pleated members are provided along the opposite sides of the cards, while the cards are held relatively together at their bottoms, whereby the cards are fanned apart at their tops for improved readability and ease of selection.

5 Claims, 8 Drawing Figures

Fig. 1.
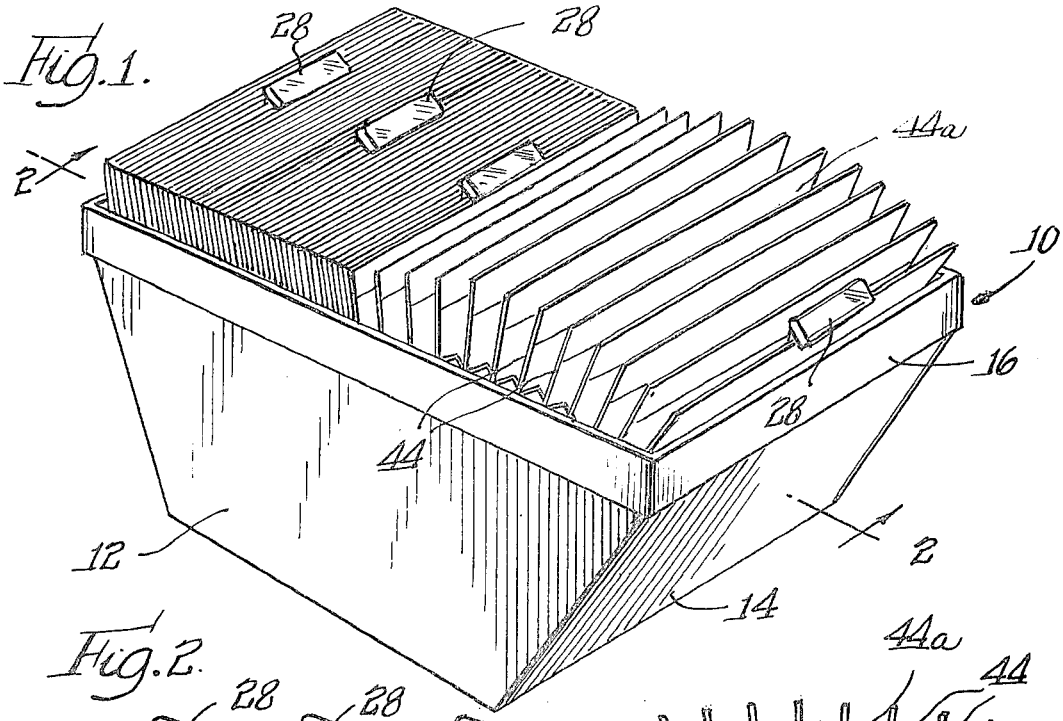
Fig. 2.
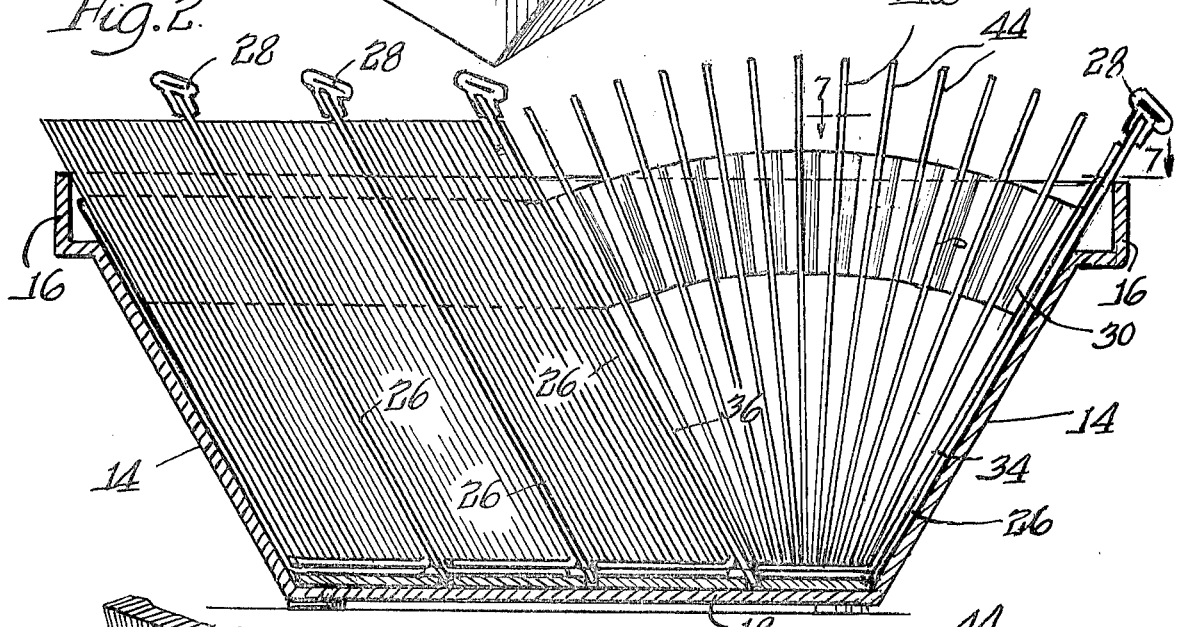
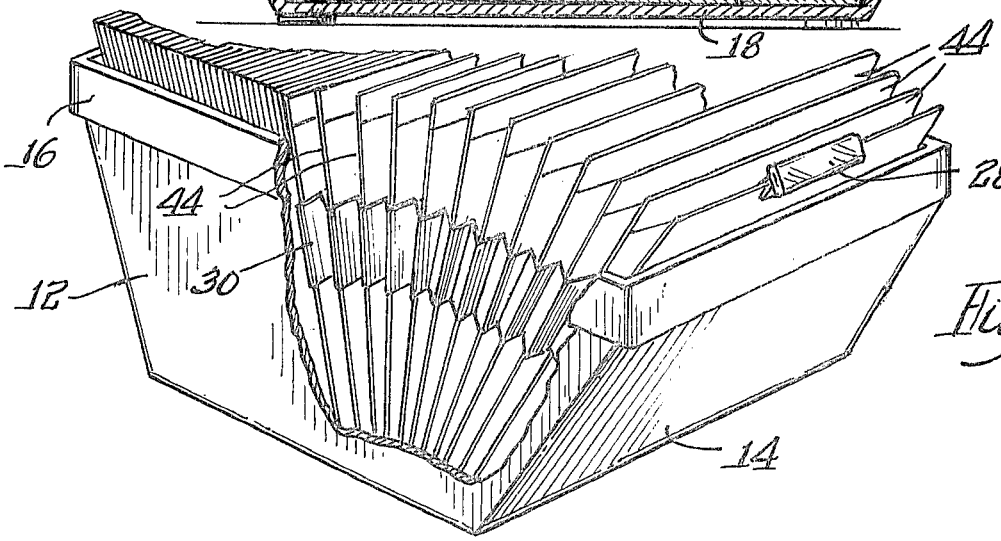
Fig. 3.

CARD FILE CONTROL

This is a continuation of application Ser. No. 479,228 filed June 14, 1974, now abandoned.

BACKGROUND OF THE INVENTION AND OBJECTS

This invention relates to card files and to control means for use therewith for fanning card members and the like apart, holding them in spaced relation, for improved readability and ease of selection from the file.

Means has heretofore been used, in card files and the like, for fanning the cards apart and for holding them in spaced relation at their tops, for improved readability and ease of selection of the cards from the file. In one form of structure heretofore used, magnetic means have been employed. In other structures heretofore used, special spring clips or the like have been provided, between each card, for effecting the separating and spacing operation. In most instances these devices have required cards which have been specially fabricated, or the use of multiple devices separately applied to or between the card members. This invention provides simplified means.

It is an object of the present invention to provide an improved card file, and improved card separating control means, for use therewith.

More specifically stated, it is an object of the present invention to provide improved card separating and control means which may be separately fabricated, and applied with ease to a card file, without the requirement for specially fabricated cards or the like.

A further object of the invention is to provide improved separating and control means which may be economically fabricated, and which are reliable in operation.

A still further object of the invention is to provide improved card separating control means, which may be fabricated as a unit, at relatively low cost, and applied as a unit to an existing card file, and thereupon used with existing conventional cards.

Various other objects, advantages and features of the invention will be apparent from the following specification, taken in reference to the accompanying drawings, wherein like reference numerals refer to like parts throughout.

BRIEF DESCRIPTION OF THE FIGURES

FIG. 1 is a perspective view of a card file incorporating card separating and control means constructed in accordance with and embodying the principles of the present invention;

FIG. 2 is a longitudinal sectional view of the card file structure shown in FIG. 1, on the line 2—2 thereof;

FIG. 3 is a partial perspective view, similar to FIG. 1, but wherein a portion of the sidewall of the card file has been broken away to better illustrate the structures of the invention;

DETAILED DESCRIPTION

Figure 4:
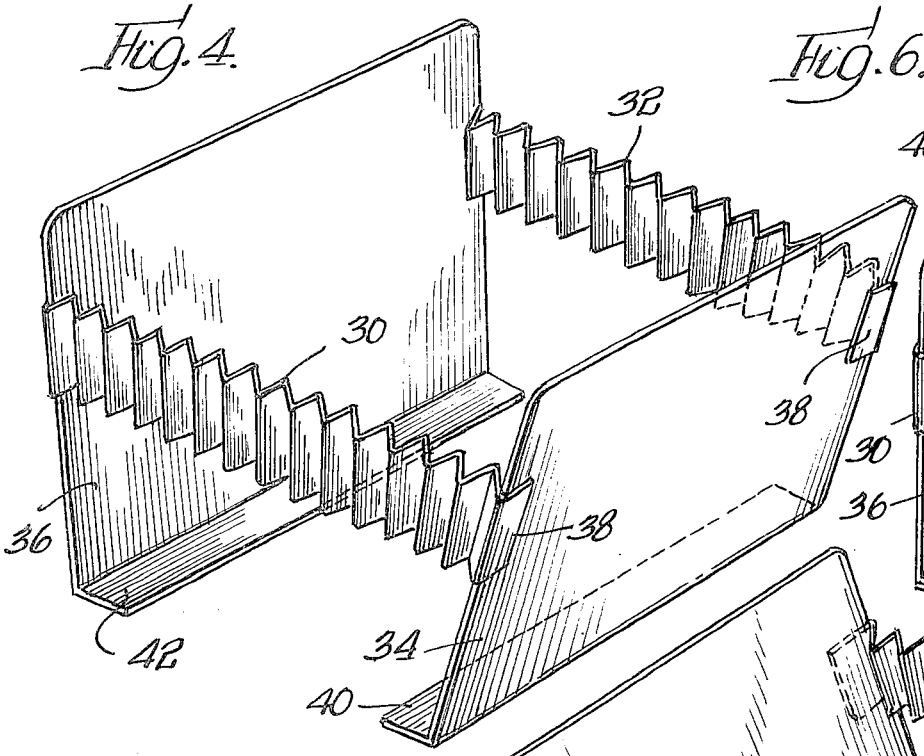
FIG. 4 is a perspective view of the card control means, or unit, disassociated from and prior to application to the card file.

Referring now more specifically to the drawings, in FIG. 1 there is illustrated a card file having a card tray, generally indicated by the reference numeral 10, composed of a pair of sidewalls, one of which is shown at 12, and a pair of ends, one of which is designated by the reference numeral 14. A rectangular frame piece, or portion, designated by the reference numeral 16, encompasses the tray sidewalls and end walls at the upper margins thereof, to impart rigidity, and a proper finish to the structure.

The tray structure, as previously described, may be generally conventional in form, and fabricated of any suitable material, such for example as plastic or metal. The tray structure is completed by a bottom wall 18, as shown in FIG. 2, which likewise may be of generally conventional structure and design.

Figure 8:
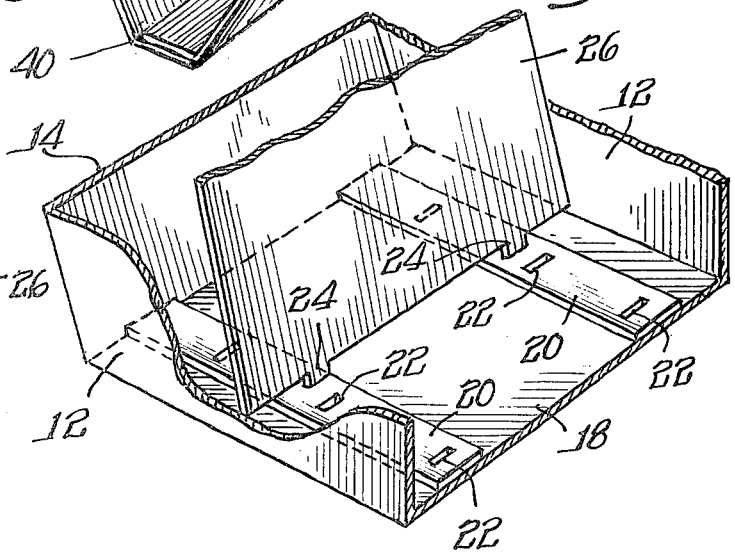
FIG. 8 is an illustrative perspective view showing a portion of the card file tray with an associated card section separating member.

However, as best shown in FIG. 8, the tray bottom may be provided with a pair of longitudinal strip members, as indicated at 20, which are in turn provided with spaced perforations 22. These perforations are adapted for cooperation with tabs or projections 24, FIG. 8, formed at the bottom of spacer plates 26, one of which is shown in slightly lifted position in FIG. 8. As best shown in FIG. 2, these spacer plates sectionalize the tray structure into individual sections, as may be desired. The spacer plates preferably are provided with handle means or tabs 28, along their upper margins, so that the plates may be rocked forwardly or rearwardly, so as to render one section or compartment of the tray available for card inspection and use. As shown in FIG. 2, the tray is provided with four sections or compartments, the spacer plates having been manipulated so as to render the forwardmost, or right end compartment, as seen in FIG. 2, available for use. The tabs 24 and perforations 22 limit the pivotal movement of the spacer plates, as will be understood.

Means is provided for effecting a separation and control of the cards within a compartment which has been rendered accessible by manipulation of the spacer plates. As illustrated in FIG. 4, in accordance with the present invention, such means comprises a unit composed of a pair of elongated pleated resilient strip members 30 and 32, and a pair of anchorage members or plates, 34 and 36, to which the ends of the strips are respectively secured. The strips may be of suitable material, such as paper or plastic, and they may be secured at their ends 38 to the anchorage plates, by adhesive or the like, as is indicated in FIG. 4.

Figure 6:
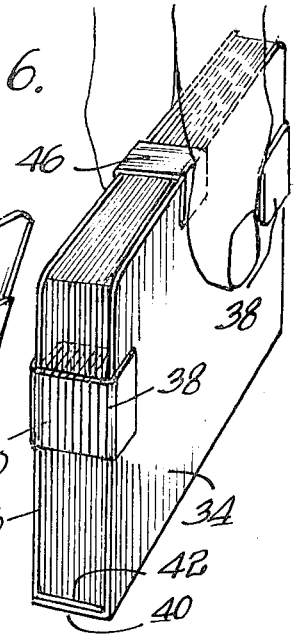
FIG. 6 is a view of the unit of FIGS. 4 and 5, shown in a collapsed position, as for transportation and sale.
Figure 5:
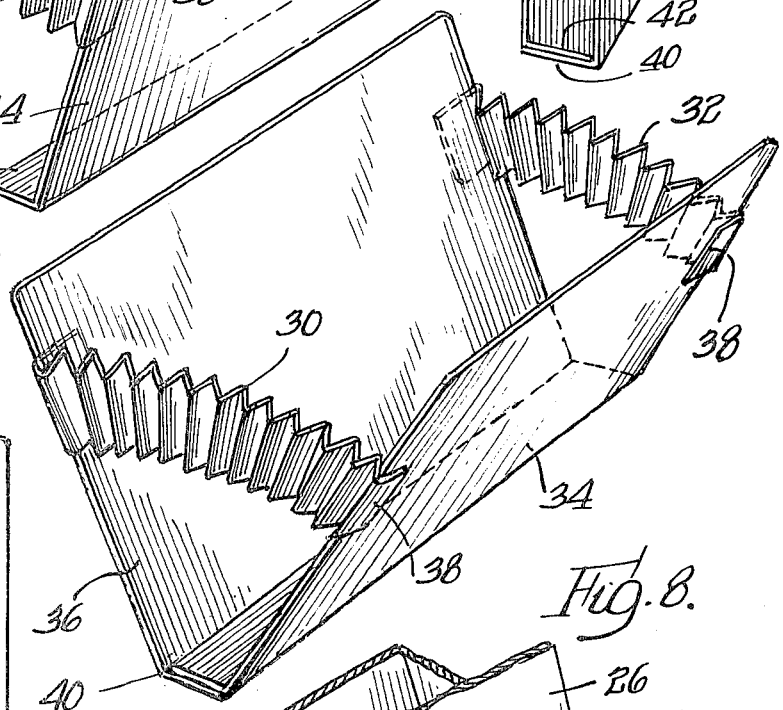
FIG. 5 is a view similar to FIG. 4, but showing the card control unit in a different position.

As shown in FIGS. 4, 5 and 6, the anchorage members or plates 34 and 36, which likewise may be suitably formed of paper or plastic, have their lower portions or margins 40 and 42 turned inwardly toward each other, the size of these margins being such, as indicated in FIG. 5, so that the anchorage plates may be brought into general juxtaposition along their lower margins, as shown, while still remaining somewhat spaced. This spacing is approximately the same as the combined pleated thickness of the separator and control strips 30 and 32, so that the unit can be brought into collapsed position, for ease of transportation and handling, as shown in FIG. 6.

Figure 7:
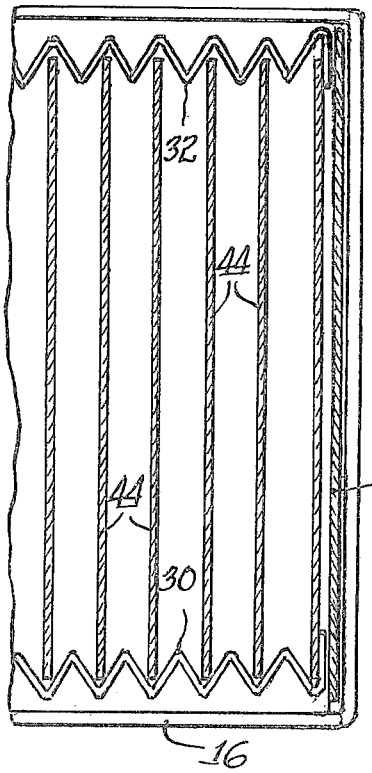
FIG. 7 is an enlarged sectional detail view, showing several cards in association with the card separating and control means, taken as indicated by the line 7—7 of FIG. 2.

The relationship of the cards to the separator and control strips 30 and 32, when the cards are in assembled position, is best illustrated in FIG. 7. It will be seen that the ends of the cards 44 lie within the pleats of the strips 30 and 32, in a manner such that one card lies within each individual pleat of the side strips. The cards are such a length or size, that they may be easily inserted into and withdrawn from the pleats of the strips.

The manner of operation of the structure is illustrated in FIGS. 1, 2 and 3. It will be seen that the resilient pleated control strips 30 and 32, effect a separation of the cards which are disposed within a compartment of the tray rendered operative by the manipulation of the spacer plates 26. The character of the separation or "fanning" of the cards which will be effected, depends upon the resiliency of the control strips, and the number of cards within an activated compartment. If there are fewer cards, and if the control strips are of such a character that they are relatively strong in their separating action, the cards 44 may be essentially uniformly spaced over a substantial number of cards, as illustrated for example in FIGS. 1, 2 and 3. On the other hand, if the cards are more numerous, and the control strips are of relatively weaker material, then the resilient separation will not be as strong, and there will be a relatively greater separation between the cards at a location where the operator may augment the separating action by a manual manipulation or pulling of one of the cards at a desired focal point. As will be understood, the control strips are preferably in all instances at least somewhat resilient, and they tend to "open up" into a position as illustrated in FIG. 4. Also, for example, if one of the cards, indicated by the reference numeral 44a in FIG. 1 is pulled by the operator to the right, as seen in FIG. 1, the control strips 30 and 32 will be somewhat stretched, to the left, whereby to augment the resilient action, and effect a greater card separation of the cards directly to the left of the card which has been manipulated by the operator.

In this manner the resiliency and strength of the separator and control strips 30 and 32 may be predetermined to give a desired character of separation to the cards.

It will be seen that the structure may be fabricated at relatively low cost. As shown in FIGS. 4, 5 and 6, the card separating structure is essentially of unit construction so that it can be preliminarily fabricated, and then assembled into an existing card file of proper size. The fanning or separating action results from the action of the resilient control strips 30 and 32, coupled with the fact that the cards are held relatively together at their bottoms by the nature of the card tray, fanning the cards apart at their top edges, as will be understood.

Referring further to FIG. 6, the flanges 40 and 42 of end members 34 and 36 may if desired be adhesively secured together, and a shipping and holding tab 46 may be removably applied to provide a readily handled unit structure.

Cards and card trays of generally conventional character may be used. The resiliency of the strips 30 and 32 maintains a separation between the pleats so that a selected card may be readily withdrawn from the tray, and replaced, as may be desired. The cards, and the side walls of the tray insure proper alignment of the control strips. As will be understood, the cards as herein referred to may be of any desired character, such for example as printed paper sheets, microfilm sheets or the like, or other type card members, conventionally used in card file structures.

The invention is claimed as follows:

1. A card file comprising a tray structure, and control means for effecting selective fanned separation of cards and the like within said tray, said control means comprising a pair of elongated pleated strip members and means supporting the strip members for disposing the same at positions spaced upwardly from the bottom of said tray and disposed along opposite sides thereof, the pleats of said strip members being resiliently urged apart and adapted to receive and separate individual cards between said pleats with the pleats maintaining the cards in substantially parallel array and in transverse edgewise alignment and being of sufficient inherent resiliency to normally tend to open up with included cards, means being provided for holding the cards relatively together at their bottoms, whereby the cards are separated at their tops by said strip members under the resilient urging of said pleats sufficient to maintain the cards in one area selectively fanned without skewing thereof for ease of viewing relative to cards in another area of the tray.

2. A card file as in claim 1 wherein anchorage members are provided at opposite ends of the strip members to which the ends are secured.

3. A card file as claimed in claim 1 wherein the tray structure is provided with at least one pivoted spacer plate effecting separation of the tray structure into a plurality of compartments with permissive selective fanning of the cards in one compartment.

4. A card file as claimed in claim 1 wherein plural sets of control means in the tray provide separate care receiving areas to be selectively activated for fanning of the cards therein under the resilient urging of the pleats in the activated area.

5. A card file as claimed in claim 4 wherein the separate areas are defined by pivoted spacer plates providing compartments for fanning of the cards in a selected compartment.

* * * * *

UNITED STATES PATENT AND TRADEMARK OFFICE

CERTIFICATE OF CORRECTION

PATENT NO. : 4,015,350

DATED : April 5, 1977

INVENTOR(S) : Rolf Zurwelle

It is certified that error appears in the above-identified patent and that said Letters Patent are hereby corrected as shown below:

Column 4, line 47, "care" should be --card--

Signed and Sealed this

*ninth* Day of *August 1977*

[SEAL]

*Attest:*

RUTH C. MASON
*Attesting Officer*

C. MARSHALL DANN
*Commissioner of Patents and Trademarks*